United States Patent [19]

Killop

[11] 4,399,678

[45] Aug. 23, 1983

[54] RACK FOR SPLINING THIN-WALL SLEEVES OF POWER TRANSMISSION MEMBERS

[75] Inventor: James T. Killop, Warren, Mich.

[73] Assignee: Anderson-Cook, Inc., Fraser, Mich.

[21] Appl. No.: 239,264

[22] Filed: Mar. 2, 1981

[51] Int. Cl.[3] ..... B21D 9/14

[52] U.S. Cl. ..... 72/88; 72/469

[58] Field of Search ..... 72/88, 90, 105, 106, 72/469

[56] References Cited

U.S. PATENT DOCUMENTS

| | | | |
|---|---|---|---|
| 2,906,147 | 9/1959 | Pelphrey | 72/105 |
| 2,930,877 | 3/1960 | Pelphrey | 72/88 |
| 3,857,273 | 12/1974 | Miller et al. | 72/469 |
| 3,872,699 | 3/1975 | Blue | 72/88 |
| 3,874,219 | 4/1975 | Miller et al. | 72/469 |
| 3,890,017 | 6/1975 | Blue | 72/88 |
| 3,982,415 | 9/1976 | Killop | 72/88 |
| 4,028,921 | 6/1977 | Blue | 72/88 |
| 4,028,922 | 6/1977 | Killop | 72/88 |
| 4,155,237 | 5/1979 | Jungesjo | 72/88 |

*Primary Examiner*—Daniel C. Crane

*Attorney, Agent, or Firm*—Reising, Ethington, Barnard, Perry, Brooks & Milton

[57] ABSTRACT

A toothed rack (22) disclosed has a toothed forming face (24) of a novel construction for forming splines (42) in a thin-wall sleeve (36) of a power transmission member (28) by meshing of the rack and a toothed mandrel (26) with the sleeve therebetween to form the splines. The toothed forming face has leading, intermediate, and trailing tooth groups (40*a*, 40*b*, 40*c*) that perform the splining. The pitch line tooth thickness of the leading tooth group is at least equal to and preferably greater than the pitch line tooth thickness of the trailing tooth group which has an addendum of a greater height than the leading tooth group. The teeth of the intermediate tooth group have an addendum height that is shorter than the teeth of the trailing tooth group and preferably equal to the addendum height of the leading tooth group. The pitch line tooth thickness of the leading tooth group is equal to and preferably greater than the pitch line tooth thickness of the intermediate tooth group. The profile of the intermediate teeth from the tip to the root thereof is the same as the profile of the trailing teeth from the tip thereof toward the root thereof for the same distance. All of the teeth have faces defining the same pressure angle as each other.

7 Claims, 7 Drawing Figures

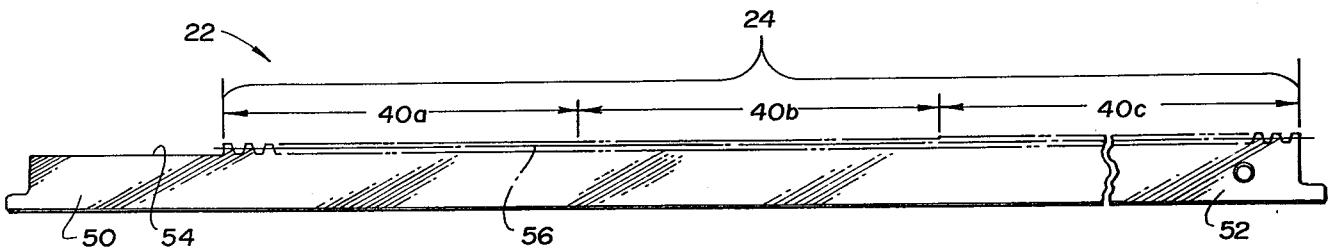
Fig. 4
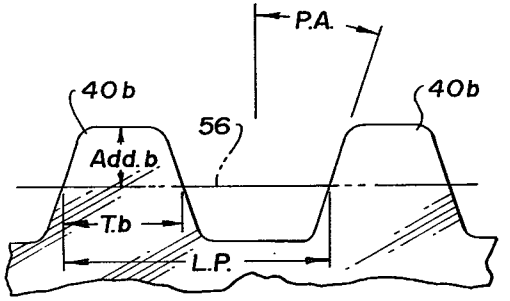
Fig. 5
Fig. 6
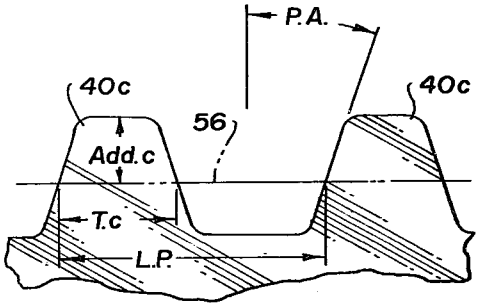
Fig. 7

RACK FOR SPLINING THIN-WALL SLEEVES OF POWER TRANSMISSION MEMBERS

TECHNICAL FIELD

This invention relates to toothed racks for splining thin-wall sleeves of power transmission members in cooperation with a toothed mandrel.

BACKGROUND ART

U.S. Pat. No. 3,982,415, which is assigned to the assignee of the present invention, discloses a machine having apparatus for splining an annular thin-wall sleeve of a power transmission member by meshing die and mandrel teeth with the sleeve located therebetween such that the resultant forming thereof provides the splines. This spline forming process takes place in a rolling manner as a mandrel on which the power transmission member is mounted rotates upon movement of toothed dies in opposite directions on opposite sides of the mandrel. An end wall of the power transmission member is clamped against an end of the mandrel during the rolling process so as to insure precise forming of the splines. Clutch hubs for automatic transmissions of road vehicles is one usage for which this spline forming process has particular utility in replacing prior impacting operations used to form clutch hub splines, as discussed in the aforementioned patent.

Teeth of the dies disclosed by U.S. Pat. No. 3,982,415 have a progressive height as well as a progressively larger tooth thickness along the pitch line thereof from the leading end of each die toward its trailing end. The spline forming thus proceeds in a progressive manner both as to the depth and width of the splines as the meshing of the die and mandrel teeth takes place.

U.S. Pat. No. 4,028,922, which also is assigned to the assignee of the present invention, discloses apparatus having toothed dies with different groups of teeth that cooperate with a toothed mandrel to form splines in a thin-wall sleeve of a power transmission member by the rolling process discussed above. Each toothed die includes a first tooth group of farther spaced teeth that form a first set of splines in the thin-wall sleeve in cooperation with the mandrel, and a second group of closer spaced teeth of each die thereafter cooperate with the mandrel to form a second set of splines between the first set of splines while meshing with the first set. Finally, the splined sleeve is again meshed with farther spaced teeth to provide correction of any out of roundness.

One embodiment of the apparatus disclosed by U.S. Pat. No. 4,028,922 includes toothed dies in the form of elongated racks having a leading tooth group of farther spaced teeth and a trailing tooth group of closer spaced teeth which are driven in a reciprocating manner to provide the initial forming of the first set of splines, the subsequent forming of the second set of splines, and the final meshing of the farther spaced teeth to correct any out of roundness. Another embodiment of the apparatus is disclosed as including toothed dies in the form of elongated racks having a leading tooth group of farther spaced teeth and an intermediate tooth group of closer spaced teeth as well as a trailing tooth group of farther spaced teeth. These dies are driven in an opposite direction to each other without any reversal to provide the initial forming of the first set of splines, the subsequent forming of the second set of splines between the first set, and the final meshing of the farther spaced teeth to correct any out of roundness. In each of these embodiments, the groups of farther spaced teeth include partial teeth therebetween for preventing the sleeve being splined from taking on a "bell mouth" shape.

U.S. Pat. No. 4,155,237, which is likewise assigned to the assignee of the present invention, discloses an automatic loader for a machine that splines thin-wall sleeves of power transmission members by the rolling process discussed above.

DISCLOSURE OF INVENTION

A toothed rack constructed in accordance with the present invention has a toothed forming face of a novel construction for forming splines in a thin-wall sleeve of a power transmission member by meshing of the rack and a toothed mandrel with the sleeve therebetween to form splines in the sleeve. The toothed forming face has a pitch line and includes leading and trailing tooth groups along the pitch line. Each tooth group has teeth spaced along the pitch line for a distance equal to at least half the circumference of the sleeve to be splined. The teeth within each tooth group have the same profile as each other and are positioned with respect to the pitch line in a uniform relationship. The teeth of the leading tooth group have a tooth thickness along the pitch line at least equal to the tooth thickness along the pitch line of the teeth of the trailing tooth group, and the teeth of the trailing tooth group have an addendum of a greater height than the teeth of the leading tooth group. Preferably, the pitch line tooth thickness of the leading tooth group is greater than the pitch line tooth thickness of the trailing tooth group.

In its preferred construction, the toothed rack also includes an intermediate tooth group located between the leading and trailing tooth groups and, like the other tooth groups, having teeth of the same profile as each other spaced along the pitch line in a uniform relationship for a distance equal to at least half the circumference of the sleeve to be splined. The teeth of the intermediate tooth group have an addendum of a shorter height than the teeth of the trailing tooth group and preferably of a height equal to the addendum of the teeth of the leading tooth group. The teeth of the leading tooth group have a pitch line tooth thickness that is at least equal to and preferably greater than the pitch line tooth thickness of the intermediate tooth group. The teeth of the intermediate tooth group have the same profile from the tip to the root thereof as the tooth profile of the trailing tooth group from the tip thereof toward the root thereof for the same distance. In addition, the leading tooth group as well as the intermediate and trailing tooth groups all have faces with the same pressure angle as each other.

Cooperation of a pair of such toothed racks and an associated toothed mandrel splines a thin-wall sleeve of a power transmission member located between the meshing rack and mandrel teeth. During such splining, the thicker teeth of the leading tooth group fully form the spline width between side walls thereof, and the intermediate tooth group thereafter forms bottom connecting lands of the splines prior to final forming by the trailing tooth group as the pair of racks are driven from an end to end relationship into an overlapping relationship. Reverse driving of the pair of toothed racks then again meshes the formed splines first with the trailing tooth group, then with the intermediate tooth group and finally with the leading tooth group in a manner that corrects any out of roundness of the splined power transmission member.

The objects, features, and advantages of the present invention are readily apparent from the following detailed description of the best mode for carrying out the invention when taken in connection with the accompanying drawings.

BRIEF DESCRIPTION OF DRAWINGS

FIG. 4 is a side elevation view of one of the toothed racks which is identical to the other one; and FIGS. 5, 6, and 7 respectively illustrate tooth profiles of leading, intermediate, and trailing toothed groups of a toothed forming face of the rack shown in FIG. 4.

BEST MODE FOR CARRYING OUT THE INVENTION

Figure 1:
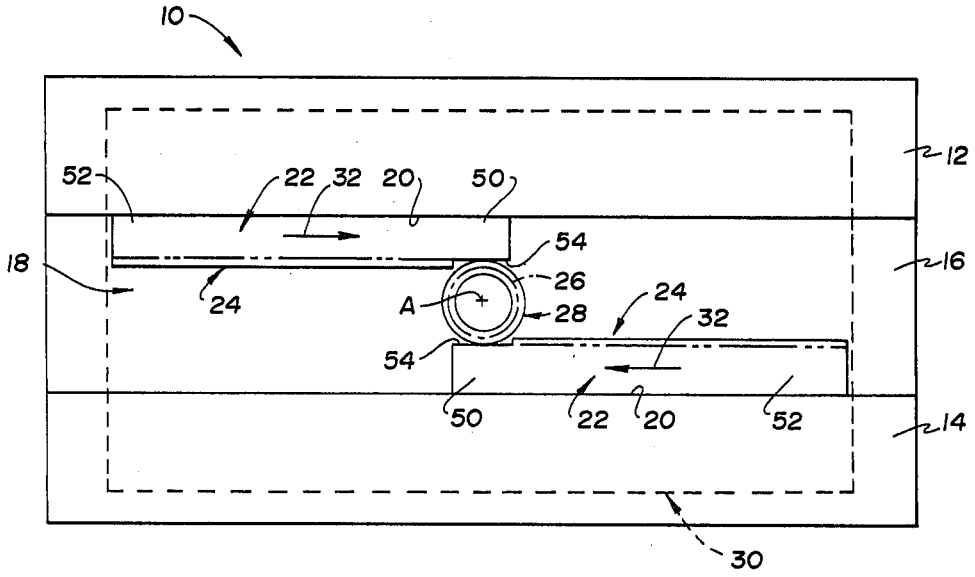
FIG. 1 is a front elevation view of a spline forming machine which utilizes toothed racks constructed in accordance with the present invention to form splines in a thin-wall sleeve of a power transmission member by meshing of the racks and an associated toothed mandrel.

Referring to FIG. 1 of the drawings, a spline forming machine indicated generally by 10 includes upper and lower bases 12 and 14 that are interconnected by a vertically extending connecting portion 16 and which project forwardly therefrom so as to define a workspace 18. Conventional slides on slideways 20 of the upper and lower bases 12 and 14 respectively mount a pair of upper and lower toothed steel racks 22 which are constructed in accordance with the present invention. As will be more fully hereinafter described, each toothed rack 22 includes a ground toothed forming face 24 extending between its leading and trailing ends. An externally toothed mandrel 26 (see also FIG. 2) is rotatably mounted within the workspace 20 about an axis of rotation A and receives an annular power transmission member 28 to be splined. A schematically indicated drive mechanism 30, such as of the type disclosed by the U.S. patent to Anderson U.S. Pat. No. 3,793,866, moves the toothed racks 22 in the direction of arrows 32 from their end to end relationship shown into an overlapping relationship and then reciprocally drives the racks back to their end to end position. A thin-wall spline forming operation on the power transmission member 28 is performed by such driving of the toothed racks 22.

Figure 2:
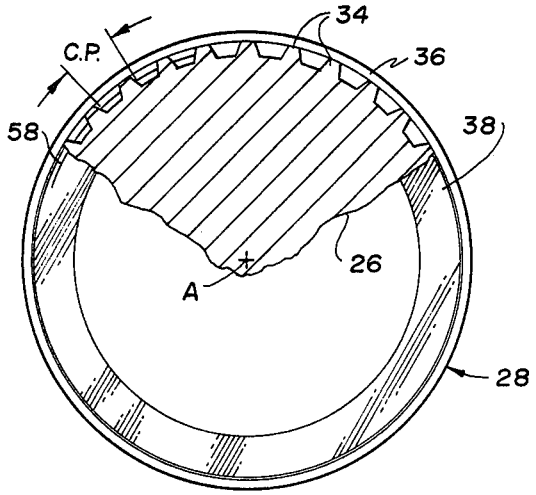
FIG. 2 is a partially sectioned view illustrating the member to be splined and the toothed mandrel on which the member is mounted during splining.
Figure 3:
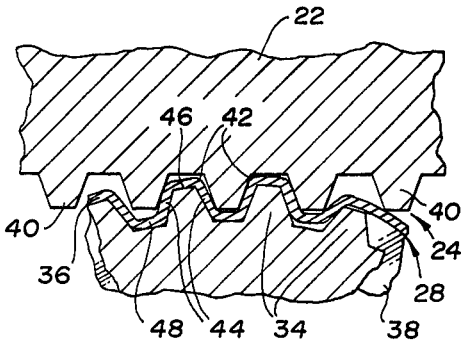
FIG. 3 is a sectional view which illustrates one of the toothed racks and the toothed mandrel during meshing thereof with the sleeve located therebetween and being splined by such meshing.

With reference to FIG. 2, the mandrel 26 includes external teeth 34 and the power transmission member 28 has a thin-wall sleeve 36 that is supported on the mandrel extending about the mandrel teeth. An end wall 38 of the power transmission member 28 has an annular shape and extends radially at one axial end of the sleeve 36 while the other end thereof is open so as to define a somewhat cup shape. Each toothed forming face 24 of the pair of racks 22 includes teeth 40 that engage the thin-wall sleeve 36 of the power transmission member 28 as shown in FIG. 3 during the splining operation such that the rack and mandrel teeth 34 and 40 mesh with the sleeve 36 therebetween so as to form splines or teeth 42 in the sleeve. The formed splines 42 include side walls 44 as well as top and bottom lands 46 and 48 that connect the top and bottom lands of the adjacent side walls.

It should be mentioned that while the term "thin-wall" is defined in standard engineering terminology to mean a round wall having an internal diameter to wall thickness ratio greater than 10, this ratio is much greater for sleeves splined by racks according to the spline forming process herein disclosed. Normally, the ratio is on the order of about 50 or more; for example, an internal diameter of $4\frac{1}{8}$ inches and a wall-thickness of 1/16 inch gives a ratio of 66.

With reference to FIGS. 1 and 4, each toothed rack 22 has a leading end 50 and a trailing end 52 between which the toothed forming face 24 extends. At the leading end 50, the rack 22 includes a recess 54 that allows the thin-wall sleeve to be positioned in alignment with the toothed forming face 24 in preparation for splining.

The toothed forming face 24 of each rack has the construction shown in FIG. 4 which includes a leading tooth group **40*a*, an intermediate tooth group 40*b*, and a trailing tooth group 40*c* extending between the leading and trailing rack ends 50 and 52. A pitch line 56 of the toothed forming face 24 extends parallel to the direction of rectilinear rack movement at a radial position with respect to the associated mandrel where the circumferential mandrel movement is equal to the rectilinear rack movement as a thin-wall sleeve is formed between the meshing rack and mandrel teeth. Each of the tooth groups 40*a*, 40*b*, and 40*c* includes teeth spaced along the pitch line 56 for a distance equal to at least half the circumference of the sleeve to be splined so that the full circumference of the sleeve is formed by each identical pair of tooth groups on the two racks. The teeth within each tooth group 40*a*, 40*b*, and 40*c* have the same profile as each other and are positioned with respect to the pitch line 56** in a uniform relationship.

With reference to FIGS. 5, 6 and 7, the teeth **40*a*, 40*b*, and 40*c* of the leading, intermediate and trailing tooth groups have profiles which are shown on an enlarged scale from FIG. 4 for purposes of illustration. Each of the tooth groups has a linear pitch L.P. equal to the circular pitch C.P. of the mandrel pitch circle 58 as shown in FIG. 2 such that the teeth mesh during the splining operation. As this splining takes place, the pitch line 56 of each toothed rack is tangent to the mandrel pitch circle 58** and moves at the same rate.

As seen by combined reference to FIGS. 5 and 7, the leading teeth **40*a* have a tooth thickness Ta along the pitch line 56 that is at least equal to the tooth thickness Tc of the trailing teeth 40*c* along the pitch line 56. The trailing teeth 40*c* have an addendum $Add._c$ between the tip thereof and the pitch line 56 of a greater height than the addendum $Add._a$ of the leading teeth 40*a* between the tip thereof and the pitch line. During the thin-wall splining, the leading teeth 40*a* fully form the spline width between the side walls 44 illustrated in FIG. 3 and the trailing teeth 40*c* thereafter fully form the spline depth. After the racks 22 have been moved from the end to end position shown in FIG. 1 such that the full length of each toothed forming face 24 has meshed with the member being splined, reverse driving of the racks by the drive mechanism 30 again meshes the splined sleeve with the leading tooth group 40*a* in a manner that has been found to correct any out of roundness of the splined sleeve. Best results are achieved in forming the splines when the pitch line tooth thickness Ta of the leading teeth 40*a* is greater than the pitch line tooth thickness Tc of the trailing teeth 40*c***.

With reference to FIG. 6, the intermediate teeth **40*b* mesh with the sleeve being splined between the leading and trailing teeth 40*a* and 40*c* during both directions of movement. The addendum $Add._b$ of the intermediate teeth 40*b* between the tip thereof and the pitch line 56 has a shorter height than the addendum $Add._c$ of the trailing teeth 40*c* such that the full depth of the splines in not completed until the trailing teeth mesh with the splines. Preferably, the addendum $Add._b$ of the intermediate teeth 40*b* is equal to the addendum $Add._a$ of the leading teeth 40*a*. The pitch line tooth thickness Ta of the leading teeth 40*a* is at least equal to and preferably greater than the pitch line tooth thickness Tb of the intermediate teeth 40*b*. Also, the tooth profile of the intermediate teeth 40*b* from the tip to the root thereof is preferably the same as the tooth profile of the trailing teeth 40*c*** from the tip thereof toward the root thereof for the same distance.

All of the teeth **40*a*, 40*b*, and 40*c* respectively shown in FIGS. 5, 6 and 7** have faces that define the same pressure angle P.A. as each other.

The following TABLE 1 lists values of the tooth parameters of one preferred embodiment of a toothed rack 22 constructed in accordance with the present invention.

TABLE 1

L.P.=0.4827 in.
P.A.=18°

Ta=0.1722 in.
$Add._a$=0.0536 in.

Tb=0.1627 in.
$Add._b$=0.0536 in.

Tc=0.1692 in.
$Add._c$=0.0636 in.

In regard to the diameter of the pitch circle of the mandrel teeth 34, reference should be made to U.S. Pat. No. 4,380,918 which has been filed concurrently herewith and is assigned to the assignee of the present invention.

While the best mode for carrying out the invention has been described in detail, those familiar with the art to which this invention relates will recognize other modes for practicing the invention as defined by the following claims.

What is claimed is:

1. In apparatus including a toothed rack and a toothed mandrel for forming splines in a thin-wall sleeve of a power transmission member by meshing of the rack and the toothed mandrel with the sleeve therebetween to form splines therein, said rack comprising: a toothed forming face including teeth that are spaced from the toothed mandrel during meshing thereof with the thin-wall sleeve located therebetween; said toothed forming face having a pitch line and including leading and trailing tooth groups along the pitch line; each tooth group having teeth spaced along the pitch line for a distance equal to at least half the circumference of the mandrel; the teeth within each tooth group having the same profile as each other and being positioned with respect to the pitch line in a uniform relationship; the teeth of the leading tooth group having a greater tooth thickness along the pitch line than the tooth thickness along the pitch line of the teeth of the trailing tooth group; and the teeth of the trailing tooth group having an addendum of a greater height than the teeth of the leading tooth group.

2. A toothed rack as in claim 1 further including an intermediate tooth group located between the leading and trailing tooth groups and having teeth spaced along the pitch line of the toothed forming face for a distance equal to at least half the circumference of the mandrel, the teeth of the intermediate tooth group having the same profile as each other and being positioned with respect to the pitch line in a uniform relationship, the pitch line tooth thickness of the leading tooth group being at least equal to the pitch line tooth thickness of the intermediate tooth group, and the teeth of the intermediate tooth group having an addendum of a shorter height than the teeth of the trailing tooth group.

3. A toothed rack as in claim 2 wherein the pitch line tooth thickness of the leading tooth group is greater than the pitch line tooth thickness of the intermediate tooth group.

4. A toothed rack as in claim 2 or 3 wherein the teeth of the leading and intermediate tooth groups have addendums of the same height as each other.

5. A toothed rack as in claim 2 wherein the teeth of the intermediate tooth group have the same profile from the tip thereof to the root thereof as the tooth profile of the trailing tooth group from the tip thereof toward the root thereof for the same distance.

6. A toothed rack as in claim 2 wherein the teeth of all of the tooth groups have faces with the same pressure angle as each other.

7. In apparatus including a toothed rack and a toothed mandrel for forming splines in a thin-wall sleeve of a power transmission member by meshing of the rack and a toothed mandrel with the sleeve therebetween to form splines therein, said rack comprising: a toothed forming face including teeth that are spaced from the toothed mandrel during meshing thereof with the thin-wall sleeve located therebetween; said toothed forming face having a pitch line and including leading, intermediate, and trailing tooth groups; each tooth group having teeth spaced along the pitch line for a distance equal to at least half the circumference of the mandrel; the teeth within each tooth group having the same profile as each other and being positioned with respect to the pitch line in a uniform relationship; the teeth of all of the tooth groups having faces with the same pressure angle as each other; the teeth of the leading tooth group having a greater tooth thickness along the pitch line than the teeth of the intermediate and trailing tooth groups; the teeth of the leading and intermediate tooth groups having addendums of the same height as each other; the teeth of the intermediate tooth group having the same profile from the tip to the root thereof as the tooth profile of the trailing tooth group from the tip thereof toward the root thereof for the same distance; and the teeth of the trailing tooth group having a tooth profile with an addendum of a greater height than the teeth of the leading and intermediate tooth groups.

* * * * *